US008505975B2

(12) United States Patent
Karlöf et al.

(10) Patent No.: US 8,505,975 B2
(45) Date of Patent: Aug. 13, 2013

(54) RELEASABLY ATTACHABLE END PIECE TO A POLE

(75) Inventors: Lars Karlöf, Hagan (NO); Svein Pedersen, Askim (NO); Elise Reiten, Bærumsverk (NO)

(73) Assignee: Swix Sport AS, Oslo (NO)

( * ) Notice: Subject to any disclaimer, the term of this patent is extended or adjusted under 35 U.S.C. 154(b) by 135 days.

(21) Appl. No.: 12/898,740

(22) Filed: Oct. 6, 2010

(65) Prior Publication Data

US 2011/0084472 A1 Apr. 14, 2011

(30) Foreign Application Priority Data

Oct. 9, 2009 (NO) ..... 20093122

(51) Int. Cl.
*A63C 11/24* (2006.01)

(52) U.S. Cl.
USPC ..... 280/824; 280/809; 280/812; 280/819

(58) Field of Classification Search
USPC ..... 280/824, 809, 819, 820, 823, 812; 285/140.1, 322, 323, 151.1
See application file for complete search history.

(56) References Cited

U.S. PATENT DOCUMENTS

| | | | | | |
|---|---|---|---|---|---|
| 2,721,084 | A | * | 10/1955 | Weiss | 280/824 |
| 3,163,437 | A | * | 12/1964 | Phillipson | 280/824 |
| 3,199,886 | A | * | 8/1965 | Dover | 280/824 |
| 3,637,229 | A | * | 1/1972 | Klemm | 280/823 |
| 4,014,559 | A | * | 3/1977 | Funke | 280/824 |
| 4,145,075 | A | * | 3/1979 | Holzmann | 285/322 |
| 4,250,348 | A | * | 2/1981 | Kitagawa | 285/322 |
| 4,358,079 | A | * | 11/1982 | Navarro | 285/151.1 |
| 4,676,525 | A | * | 6/1987 | Sorlien et al. | 280/824 |
| 4,700,975 | A | * | 10/1987 | Ehemann et al. | 280/824 |
| 4,787,657 | A | * | 11/1988 | Henniger | 285/323 |
| 5,823,102 | A | * | 10/1998 | Will | 108/152 |
| 6,203,064 | B1 | * | 3/2001 | Zaltron | 280/824 |
| 6,350,955 | B1 | * | 2/2002 | Daoud | 285/322 |
| 6,488,317 | B1 | * | 12/2002 | Daoud | 285/322 |
| 7,926,849 | B2 | * | 4/2011 | Lenhart | 280/824 |
| 7,963,567 | B2 | * | 6/2011 | Gallardo et al. | 285/140.1 |

FOREIGN PATENT DOCUMENTS

| | | |
|---|---|---|
| CH | 258030 | 11/1948 |
| CH | 472227 | 5/1969 |
| CH | 545635 | 2/1974 |
| EP | 1025883 | 8/2000 |
| EP | 1676608 | 7/2006 |
| FR | 966364 | 10/1950 |
| JP | 50076964 | 7/1975 |
| RU | 2185867 | 7/2002 |
| SE | 85615 | 2/1936 |
| SE | 154852 | 6/1956 |

* cited by examiner

*Primary Examiner* — Hau Phan
(74) *Attorney, Agent, or Firm* — Christian D. Abel

(57) ABSTRACT

The present invention pertains to a solution for releasably attaching and fastening an end piece to a pole such as a ski pole suited for cross country skiing, downhill skiing roller skiing or walking. The end piece may be a basket providing a thrust bearing surface on snow or it may be an end piece with a sharp point for use in walking or roller skiing.

10 Claims, 3 Drawing Sheets

RELEASABLY ATTACHABLE END PIECE TO A POLE

TITLE OF THE INVENTION

The present invention pertains to a solution for releasably attaching and fastening an end piece to a pole such as a ski pole suited for cross country skiing, downhill skiing, roller skiing or walking.

The end piece may be a basket providing a thrust bearing surface on snow or it may be an end piece with a sharp point for use in walking or roller skiing. The invention furthermore pertains to several embodiments of the general solution, i.e. several detailed solutions within the general concept.

BACKGROUND OF THE INVENTION

Poles, such as ski poles and their end pieces, whether a basket or an alternative design, are designed by taking into consideration a number of different parameters. First of all the weight of the pole is important. This pertains to the weight in general but especially to the weight of the pending part of the pole, i.e. the part of the pole furthest away from the handgrip. The handgrip will act as a fulcrum point during use and the mass rotating about the fulcrum point will thus invoke a moment of inertia. The weight towards the lower end of the pole will greatly influence the moment of inertia deriving from the length of the pole and the mass along the length of the pole and also any mass close to the end of the pole, i.e. the end piece. This will influence the stability of the pole as well as other properties of the pole in use. In general the pole shall be easy to handle and stable in addition to having a advantageous shape when considering wind resistance in use.

One way of enhancing the design of the pole is thus to design the actual pole body in a way that reduces or limits the weight towards the lower end of the pole.

Another approach to the design of the pole is to limit the weight of the end piece at the end of the pole, as this represents the mass furthest away from the fulcrum point for the pole and thus represents a substantial contribution to the moment of inertia. If the end piece is a basket it must still be able to perform its role and fulfill its purpose in providing a thrust bearing surface against the snow, enabling the user to use the ski pole efficiently to provide a forward thrust and thus gain speed ahead. The balance between the weight of the basket and the robustness and strength of the end piece, such as a basket may be a difficult compromise on the path to optimizing the motion dynamics of the ski pole. The compromise may end up with a more fragile basket.

The fastening of the end piece to the pole body, i.e. the connection between the end piece and the pole may also affect the motion dynamics of the pole as the connection may contribute to the weight close to the end of the pole and as the connection is close to the lower end of the pole the weight may greatly influence the moment of inertia.

Furthermore, if the end piece, in the endeavor to reduce the weight of the end piece, turns out to be of a more fragile design, it may we advantageous to be able to replace the end piece in the event it is damaged or destroyed. Especially when taking into account that materials in modern poles are rather expensive, it may be advantageous to be able to continue to use the pole body if it is intact, by replacing a nonfunctional basket.

For other reasons it may also be advantageous to be able to replace the end piece. It may then be possible to use the same pole body for several purposes. E.g. a basket used on ski poles will ideally have different shapes and sizes depending on the snow conditions as the thrust bearing surface of the basket may have variable size and shape. Hence, a replaceable basket would be advantageous. Also the user could be able to use the same poles for snow skiing and roller skiing. As the pole body may be used for several different purposes, the end piece could also be replaceable.

In most cases however the end piece such as e.g. a basket is attached to the pole using an adhesive e.g. glue and is thus not replaceable without professional equipment and a time consuming process, if at all possible. In alternative embodiments the end piece may be attached to the pole body through a coupling e.g. a bayonet coupling. Prior art solutions may be found in DE 698 14 553 T2 describing a bayonet coupling. EP 1 676 608 shows a similar solution with a locking mechanism and U.S. Pat. No. 4,669,752 teaches a locking mechanism between a basket and a ski pole.

Finally, as the design of poles is developed and especially ski pole bodies, the bodies may come in different shapes and sizes. The solution for fastening an end piece to the end of a pole must thus be versatile and general and should encompass various pole designs.

SUMMARY OF THE INVENTION

Based on the above considerations the present invention relates to releasably attachable end piece for a pole, which pole comprise a pole body with a gripping area for the end piece close to the lower end of the pole body, which end piece comprise a lower end piece with a fastening hub and a upper end piece locking device. The two parts of the end piece are deigned to be attached to the pole body in the area of the griping area in such a way that the upper end piece locking device will lock the lower end piece in a fastened grip to the pole. The locking device is releasably attached to the lower end piece through a mutually complementary design enabling the upper end locking device to lock the lower end piece to the pole body. The invention is thus characterized in that the fastening hub of the lower end piece has a hollow interior with an internal cross section essentially complementary to the cross sectional exterior of the pole body in the gripping area of the pole body. This allows the pole body to be of various cross sections and the interior of the fastening hub of the lower end piece is at all times complementary shaped. I.e. the lower end piece will always fit onto the pole body in the area of the gripping area.

Furthermore the cross sectional exterior of the fastening hub is essentially complementary to the cross sectional interior of the upper end piece locking device. This allows the locking device to be fitted on top of the fastening hub of the lower end device. Again the two parts are mutually complementary shaped and the top end piece will be able to fit on the fastening hub.

Furthermore the fastening hub and the upper end piece locking device are each fitted with complementary shaped locking means. In order to lock the lower end piece to the pole body the locking means will be used. According to the invention both the upper and lower end piece have complementary locking means allowing the upper part to releasably lock onto the lower end part and furthermore lock the lower end piece to the pole body.

Finally, as the end piece is releasably attachable to the pole the two engaging parts i.e. the upper end piece and the lower end piece can be either engaged or disengaged. Thus the lower end piece and upper end piece locking device may be in an inactive position where the lower end piece is disengaged from the upper end piece locking device, or the lower end piece and upper end piece locking device may in an active position. In the active position the lower end piece is situated on the ski pole in the gripping area of the ski pole and the upper end piece locking device is connected to the lower basket piece providing a locked connection between the lower basket piece and the gripping area of the pole body.

In an alternative embodiment the hollow interior of the fastening hub of the lower end piece has a depth at least equal to the distance from the gripping area of the pole body to the furthest end of the pole body. This will ensure that the lower end piece may be attached on the end of the pole body and the fastening hub will still be in the proximity of the gripping area. Depending on the design of the lower end piece and the pole body there may be several different ways of placing the lower end piece in a correct position. If the hollow interior of the fastening hub is open ended I both ends then the positioning of the lower end piece will be governed by the placing of the gripping area. If however the hollow interior is closed at the end, and the depth is as set forward in this embodiment then the lower end piece will achieve an approximately correct position by pushing the pole body all the way into the interior of the fastening hub.

The main task of the gripping areas is to increase the friction in the connection between the pole body and the lower end piece. In various embodiments the gripping area of the pole body may be a slender inward facing arc or any other distortion of the diameter or circumference. Thus the gripping area of the pole body may be a roughened surface area of the pole body. This may come from mechanical or chemical treatment of the pole body in the gripping area.

In order to make sure that the fastening hub may be securely fastened to the pole body, in one embodiment the fastening hub is split in its longitudinal direction into two or more fastening hub tongues and that there is a gap between the tongues.

Even though the fastening hub may be of various shapes and types they have in common that the fastening hub shall fasten the end piece to the pole body in the area of the gripping area through friction rather than chemical adhesives. In order to obtain and maintain the fastening grip between the pole body and the lower end piece it is important that the lower end piece, and especially the fastening hub is of such a design that the pole body is pushed into the hub and the upper end piece locking device is used to lock the lower end piece onto the pole body. The locking is achieved through the squeezing of the fastening hub around the pole body and then securing the engagement with the complementary shaped locking means.

E.g. when the end piece is a basket for use in snow the basket may be prone to extra damage and load from other skiers and poles. In order to make sure that the fastening hub is securely fastened to the pole body the interior cross section of the fastening hub is complementary to the pole body, and containing gripping means extending towards the gripping area of the pole. These gripping means may enhance the grip between the lower end piece and the pole body.

In order to secure the upper end piece to the lower end piece and the lower end piece to the pole, the fastening hub and the upper end piece locking device may each have complementary shaped threads, where the threads on the fastening hub are placed substantially in the area of the fastening hub tongues. By entering the threads into a screw connection it will be possible to screw the top end piece onto the threads of the fastening hub. In this embodiment this will squeeze the tongues together and towards the pole body, forming a releasable but still firm friction based grip on the pole body in the gripping area. Furthermore, in order to secure the screw connection even further the threads at least on one of the fastening hub or upper end piece locking device may be conical.

If other securing means are used, e.g. bayonet couplings, snap couplings or otherwise, the fastening hub and the upper end piece locking device each may have complementary shaped locking devices conically shaped in the longitudinal direction of the fastening hub, pointing towards the upper end of the pole.

The end piece for a pole as described above may come in different shapes and sizes for different usage. In one further embodiment a releasably attachable end piece according to the above may be used for skiing where the lower end piece further comprise a thrust bearing surface facing essentially away from the fastening hub and comprising a sharp point essentially in the longitudinal extension of the pole body.

BRIEF DESCRIPTION OF THE DRAWINGS

A particularly advantageous embodiment of the present invention is furthermore presented in the accompanying drawings, where.

DETAILED DESCRIPTION OF THE INVENTION

Figure 1:
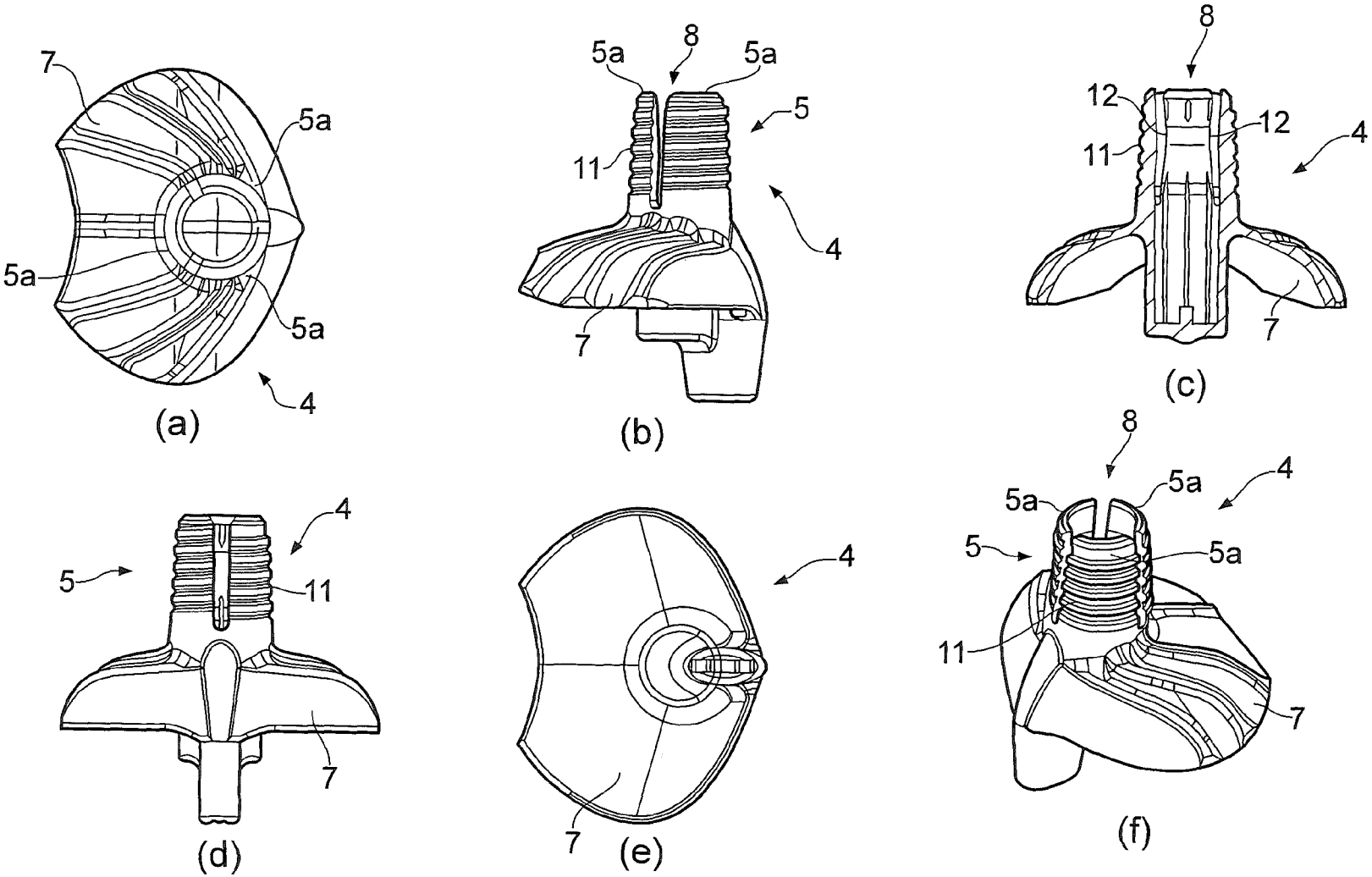
FIG. 1*a-f* presents the lower end piece for a basket for use on snow.

FIG. 1*a* to 1*f* show a particular lower end piece 4 shaped as a basket for use on snow. The fastening hub 5 is shown with a cylindrical inner cross section in the hollow interior 8 as this is complementary to the pole body 1 to be used with the basket. Furthermore the end piece 4 has a thrust bearing surface 7 for engagement with the snow. The snow will be firmly packed underneath the basket and will provide the user with the opportunity to transmit force into the ground in order to gain forward movement.

The fastening hub 5 can be seen split into three similarly shaped tongues 5*a* forming a gap between two and two of the tongues 5*a*. This provides the fastening hub with a certain flexibility and allows the tongues to be pushed towards the interior of the fastening hub 5 when the top end locking device 6 is applied onto the fastening hub 5.

Figure 2:
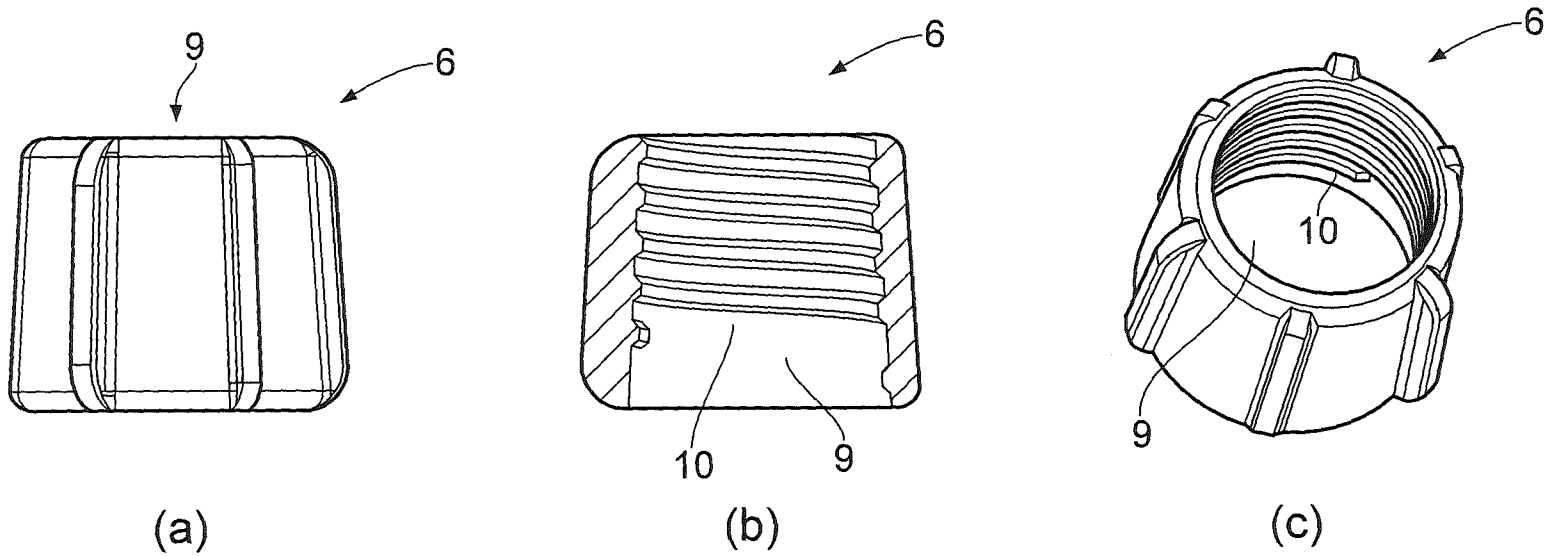
FIG. 2*a-c* presents the upper end piece locking device.

The top end locking device is shown in FIG. 2*a-c*, in this embodiment resembling a nut with internal threads 10 and an internal cross sectional interior 9 being complementary in shape and size to the outer cross section of the fastening hub 5. In other words the top end locking device 6 will be screwed on as a nut on the fastening hub 5.

Figure 3:
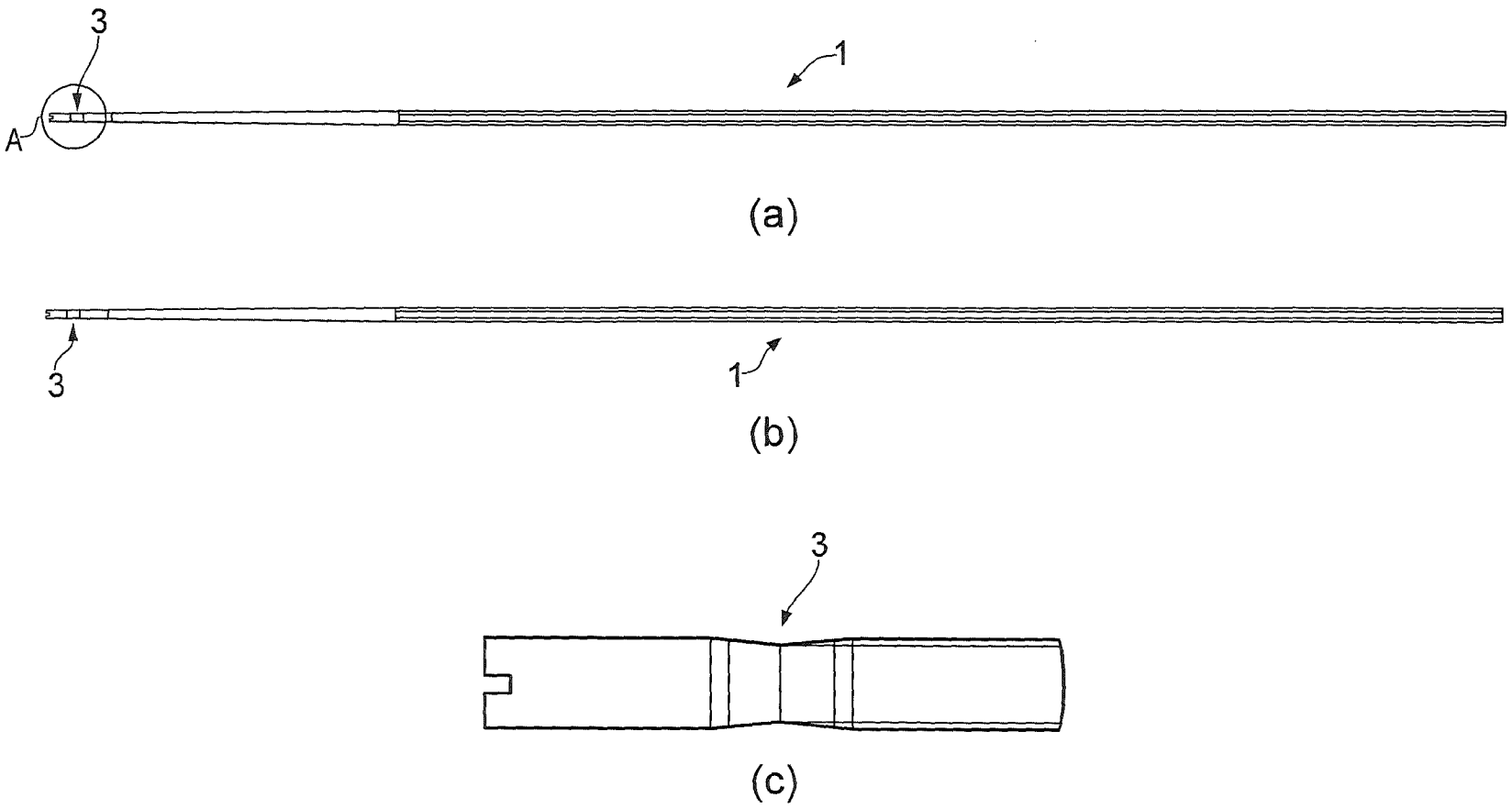
FIG. 3*a-c* presents a pole body with an embodiment of a gripping area.

The pole body 1 is furthermore shown in FIG. 3 as a slender pole of a given cross section. Towards the lower end of the pole there is a gripping area 3. The gripping area is marked with the circle A in FIG. 3*a* and an enlarged view is shown in FIG. 3*c*.

The gripping area 3 is in the embodiment shown as a slender arc, or a section of the pole body with a reduced diameter. By inserting the end of the pole body 1 into the interior 8 of the fastening hub 5, or in other words push the end piece 4 with the fastening hub first in the direction of the arrow B in FIG. 3*c*, the lower end piece will become positioned on the bottom of the pole body 1.

At the bottom of the hollow interior 8 of the fastening hub 5 there is a steering knob 14 complementary shaped to the steering slot 13 at the end of the pole body. The steering slot and steering knob may be of different size and shape, however they should be shaped so that the lower end piece preferably only can be positioned one or two ways. This may be used to synchronize the orientation of the end piece with e.g. a handle at the top of the pole or if the cross section of the pole body requires a particular orientation of the end piece.

Furthermore in order to make sure that the fastening hub 5 and the end piece is securely fastened to the pole body, the interior 8 of the fastening hub 5 is fitted with gripping means 12 facing towards the gripping area 3 of the pole body. The gripping means shown in FIG. 1*c* are simply slight protrusions. When the threads 10 of the upper end piece 6 are entered onto the threads 11 on the fastening hub 5, the protrusions of gripping means 12 are pushed towards the gripping area 3 of the pole and will provide a secure friction based connection.

By unscrewing the top end piece locking device 6 it becomes possible to release the end piece from the pole 1. A new end piece may be entered onto the end of the pole and the top end piece may again be screwed onto the fastening hub 5.

The situation where the upper and lower end pieces are separate and not in engagement may be called the inactive or passive stage. When the upper end piece locking device 6 however is entered onto the threads 11 of the fastening hub 5, the end piece is in an active stage where the friction connection between the end piece and the pole has replaced the chemical adhesive fastening. Thus the end piece has become releasable and attachable.

Especially the threads 11 and 10 may be regarded as just an embodiment, as there may be several alternative embodiments encompassed. Bayonet couplings and other embodiments of male and female couplings may be used.

Also the size and shape of the pole body cross section may vary and thus also the inner cross section of the fastening hub 5.

The inner cross section of the upper end piece locking device 6 may be similar to the cross section of the pole, however the inner cross section of the upper end piece is predominantly governed by the outer cross sectional shape and size of the fastening hub 5.

The invention claimed is:

1. A releasably attachable end piece for a pole (1), which pole comprises a pole body (1) with a gripping area (3) for the end piece close to the lower end of the pole body (1), said end piece comprising a lower end piece (4) with a fastening hub (5) and an upper end piece locking device (6), wherein the fastening hub (5) of the lower end piece (4) has a hollow interior (8), being closed at its bottom end, and with an internal cross sectional essentially complementary to the cross sectional exterior of the pole body (1) in the gripping area (3) of the pole body (1), and the cross sectional exterior of the fastening hub (5) is essentially complementary to a cross sectional interior (9) of the upper end piece locking device (6), and the fastening hub (5) and the upper end piece locking device (6) are each fitted with complementary shaped locking means (10,11), and the lower end piece (4) and upper end piece locking device (6) are arranged to alternately be set in an inactive position where the lower end piece (4) is disengaged from the upper end piece locking device, or in an active position, wherein the lower end piece (4) is situated on the ski pole in the gripping area (3) of the ski pole and the upper end piece locking device (6) is connected to the lower end piece (4) providing a locked connection between the lower end piece (4) and the gripping area (3) of the pole body (1).

2. A releasably attachable end piece according to claim 1, wherein the hollow interior (8) of the fastening hub (5) of the lower end piece (4) has a depth at least equal to the distance from the gripping area (3) of the pole body (1) to the furthest end of the pole body (1).

3. A releasably attachable end piece according to claim 1, wherein the gripping area (3) of the pole body (1) is a slender inward facing arc.

4. A releasably attachable end piece according to claim 1, wherein the gripping area (3) of the pole body (1) is a roughened surface area of the pole body (1).

5. A releasably attachable end piece according to claim 1, wherein the fastening hub (5) is split in its longitudinal direction into two or more fastening hub tongues (5*a*) and that there is a gap between the tongues (5*a*).

6. A releasably attachable end piece according to claim 1,wherein the interior cross section (8) of the fastening hub (5) is complementary to the pole body (1), and containing gripping means (12) extending towards the gripping area (3) of the pole.

7. A releasably attachable end piece according to any one of claims 1 to 6, wherein the fastening hub (5) and the upper end piece locking device (6) each have complementary shaped threads (10,11), where the threads (11) on the fastening hub (5) are placed substantially in the area of the fastening hub tongues (5*a*).

8. A releasably attachable end piece according to claim 7, wherein the threads (10,11) at least on one of the fastening hub (5) or upper end piece locking device (6) are conical.

9. A releasably attachable end piece according to any one of claims 1 to 6, wherein the fastening hub (5) and the upper end piece locking device (6) each have complementary shaped locking devices conically shaped in the longitudinal direction of the fastening hub, pointing towards the upper end of the pole.

10. A Ski pole, comprising a releasably attachable end piece according to claim 1.

* * * * *